US005967063A

United States Patent [19]

Wu

[11] Patent Number: 5,967,063

[45] Date of Patent: Oct. 19, 1999

[54] SEA-GOING VESSEL WITH A SOLID-WASTE INCINERATOR

[76] Inventor: Yi-Jun Wu, No. 133, Erh-Sheng-Erh Rd., Chien-Chen Dist., Kaohsiung City, Taiwan

[21] Appl. No.: 09/074,841

[22] Filed: May 8, 1998

[51] Int. Cl.[6] ..... F23G 5/00; F23G 5/40; B63B 17/06

[52] U.S. Cl. ..... 110/240; 110/210; 110/215; 110/259; 114/26; 114/73; 114/187; 114/270

[58] Field of Search ..... 110/240, 203, 110/208, 210, 211, 215, 216, 233, 234, 235, 238, 241, 255, 259, 293, 295, 346, 104 R, 349; 114/26, 72, 73, 74 R, 187, 270

[56] References Cited

U.S. PATENT DOCUMENTS

| | | | |
|---|---|---|---|
| 2,046,112 | 6/1936 | Felton, Jr. | 110/240 |
| 2,244,024 | 6/1941 | Schadek | 110/240 |
| 2,442,686 | 6/1948 | Guerchoux | 110/240 X |
| 3,663,149 | 5/1972 | Heagler . | |
| 4,552,082 | 11/1985 | Grey | 114/26 |
| 5,067,425 | 11/1991 | Sporleder | 114/26 |
| 5,324,217 | 6/1994 | Mineo | 114/270 X |

FOREIGN PATENT DOCUMENTS

| | | | |
|---|---|---|---|
| 3-110313 | 5/1991 | Japan | 110/240 |
| 575 101 | 4/1976 | Switzerland | 110/240 |

*Primary Examiner*—Ira S. Lazarus
*Assistant Examiner*—Ljiljana V. Ciric
*Attorney, Agent, or Firm*—Ladas & Parry

[57] ABSTRACT

A waste-disposing sea-going vessel includes a vessel body that carries solid waste-holding containers to a site at sea far away from land. The vessel body further has an incinerator to incinerate the solid wastes of the containers, a scrubbing chamber to scrub the smoke produced by the incinerator via sea-water, and a neutralization chamber to spray an alkaline solution onto the products produced by the scrubbing chamber, thereby removing hazardous particles before the incinerated wastes are discharged into the sea. A smoke-conveying pipe is further provided to connect a chimney of the incinerator to the scrubbing chamber, and a catalyst converter is provided in the smoke conveying pipe to remove some hazardous smoke particles by filtration and chemical conversion before the post-treatments conducted by the scrubbing chamber and the neutralization chamber.

8 Claims, 3 Drawing Sheets

SEA-GOING VESSEL WITH A SOLID-WASTE INCINERATOR

BACKGROUND OF THE INVENTION

1. Field of the Invention

This invention relates to a sea-going vessel for disposing wastes, more particularly to a sea-going vessel which is provided with a solid-waste incinerator and enclosed chambers for post-treatment of the products of incineration so as to remove hazardous substances therefrom.

2. Brief Description of the Related Art

Disposal of industrial and medical wastes by dumping into the sea or disposal sites on land is not safe for they contain hazardous chemicals and infectious viruses which will pollute underground water resources and the sea and which will endanger to biological systems. Although such hazardous wastes can be eliminated by incineration, incinerators installed on land have caused serious air pollution problems, such as the acidifying of the atmosphere to produce acid rain, the production of holes in the ozone layer, etc., which are harmful to living things. On the other hand, sites for incineration available on land have become limited due to the increasing population. People tend to deny the use of their environment as disposal sites. In order to provide an efficient solution to the problem of disposing such dangerous wastes, incineration of wastes far away from land is desirable.

SUMMARY OF THE INVENTION

An object of the invention is to provide a solid waste disposing sea-going vessel to incinerate dangerous wastes at sea far away from land.

Another object of the invention is to provide a seagoing vessel with an incinerator and enclosed chambers for post-treatment of the products of incineration, thereby effectively eliminating harmful substances before the incinerated wastes are discharged into sea.

According to the present invention, a waste-disposing sea-going vessel comprises: a vessel body; at least one incinerator mounted on the vessel body and having a waste inlet and a chimney; a plurality of containers disposed on the vessel body to receive solid wastes; delivery means for delivering the solid wastes from the containers to the waste inlet; a scrubbing chamber having a first spraying unit to spray sea-water onto the smoke directed to the scrubbing chamber from the chimney; a smoke-conveying pipe connected to the chimney and the scrubbing chamber so as to direct the smoke from the chimney to the scrubbing chamber; a neutralization chamber connected to the scrubbing chamber and having a second spraying unit to spray an alkaline solution onto the products of scrubbing which enter the neutralization chamber from the scrubbing chamber; and means for discharging the products resulting from the neutralization chamber into the sea.

Preferably, the delivery means comprises a belt conveyor provided at the waste inlet to receive the solid wastes from the containers and to feed the same into the incinerator; a tilting device having a tilting platform to receive and tilt the containers so as to deliver the solid wastes from the containers to the conveyor belt; and a transporting cart to transport the containers to the tilting platform, the transporting cart having a crane to deliver the containers onto the tilting platform.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
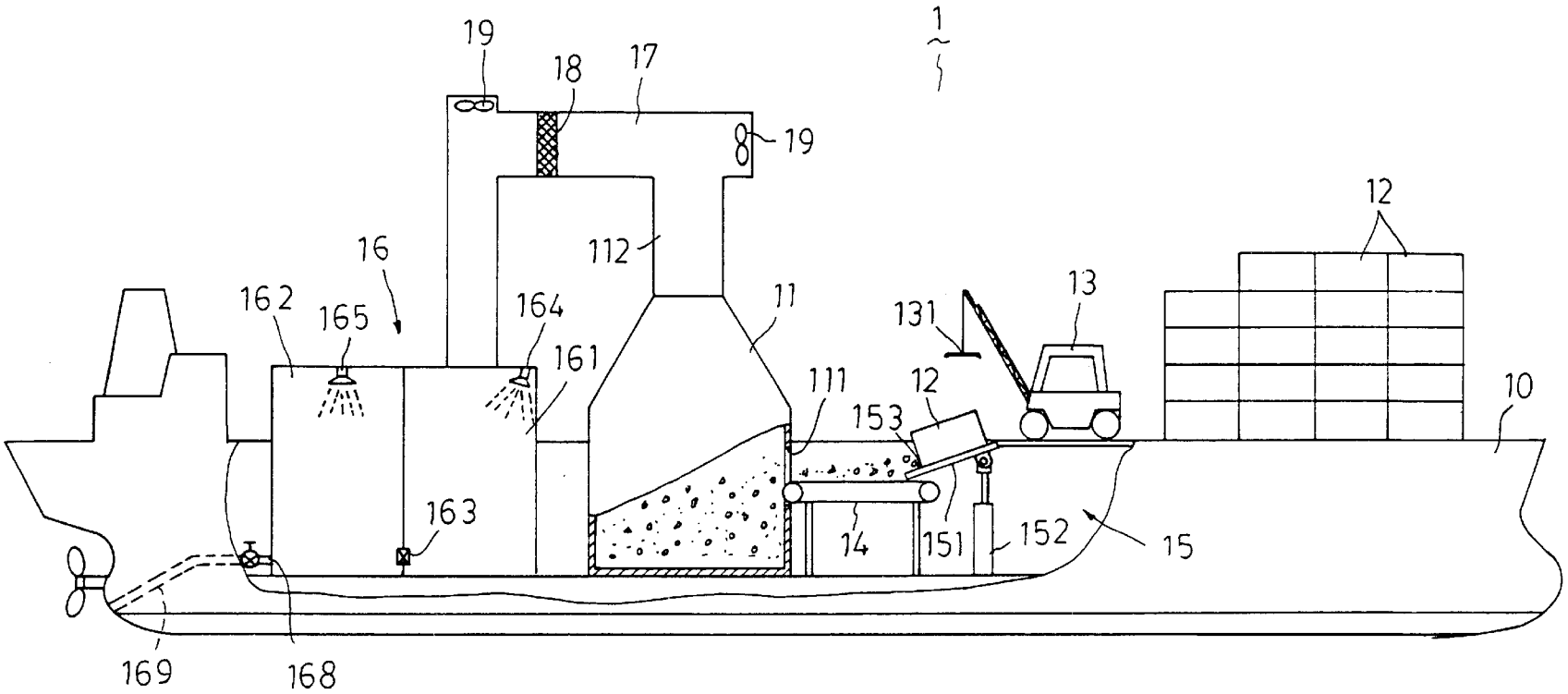
FIG. 1 is a schematic view illustrating an embodiment of a waste-disposing sea-going vessel according to the present invention.

Referring to FIG. 1, a sea-going vessel 1 is shown to include a vessel body 10, an incinerator 11, a plurality of solid waste containers 12 provided on the deck of the vessel 1, transporting carts 13 (only one cart is shown) for transporting the waste containers 12 , conveyor belts 14 (only one is shown), tilting devices 15 (only one is shown), a scrubbing chamber 161, a smoke conveying pipe 17 to intercommunicate a chimney 112 of the incinerator 11 and the scrubbing chamber 16, and a discharge pipe 169 communicated with a neutralization chamber 162.

The incinerator 11 is provided with three waste inlet ports 111. The conveyor belts 14 are provided adjacent the waste inlet ports 111, respectively, in order to feed the solid wastes from the containers 12 into the incinerator 11. Each transporting cart 13 has a crane 131 to lift and carry the containers 12 to tilting platforms 151 of the tilting devices 15. Each tiling platform 151 is operated by a hydraulic lift 152 which is disposed below the tilting platform 151 to perform a tilting operation. A stop member 153 is disposed on each tilting platform 151 in order to stop the containers 12 from sliding downward when the tilting platform 151 is tilted.

The scrubbing chamber 161 has a passage 163 which intercommunicates the scrubbing chamber 161 and the neutralizing chamber 162. The scrubbing chamber 161 is provided with a first spraying device 164 to spray sea-water onto the smoke directed into the scrubbing chamber 161 from the chimney 112. The neutralization chamber 162 is provided with a second spraying device 165 to spray an alkaline solution. The discharge pipe 169 is connected to the neutralization chamber 162 via a discharge port 168.

Figure 2:
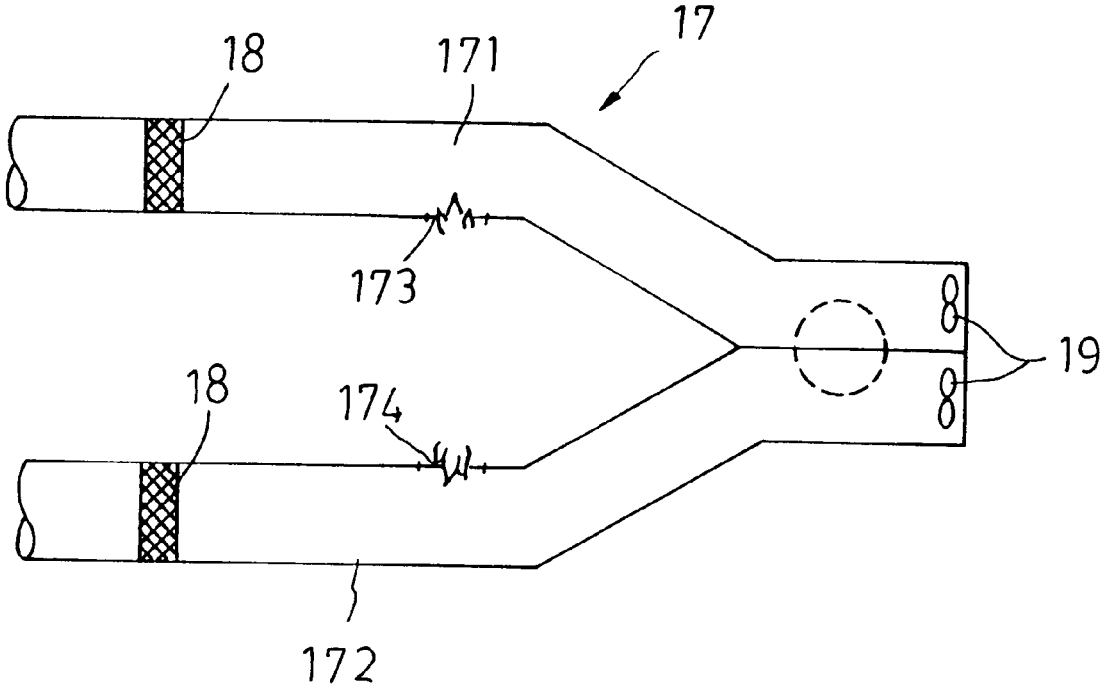
FIG. 2 is a schematic view showing a portion of the embodiment of FIG. 1.

As shown in FIG. 2, the smoke conveying pipe 17 includes a bifurcated portion having two branch pipes 171 and 172 which are respectively connected to the scrubbing chamber 161. The branch pipes 171 and 172 are provided with a secondary burning unit which includes two flame inlet ports 173 and 174. Catalyst converters 18 are disposed in the branch pipes 171 and 172 downstream of the flame inlet ports 173 and 174. Exhaust fans 19 are provided in the branch pipes 171 and 172 to fan the smoke of incineration.

In operation, the containers 12, which are filled with solid wastes on land, are loaded on the vessel 1 so as to incinerate the solid wastes at sea. The transporting carts 13 transport the containers 12 to the tilting platforms 151 where the containers 12 are tilted to deliver the solid wastes onto the conveyor belts 14. The conveyor belts 14 feeds the solid wastes into the incinerator 11. The resulting smoke or incineration products flow upward through the chimney 112 of the incinerator 11. The smoke-conveying pipe 17 directs the smoke which flows upward from the chimney 112 in a downward direction to the scrubbing chamber 161. The exhaust fans 19 function to accelerate the flowing rate of the smoke. At the flame inlet ports 173 and 174, ash particles contained in the smoke as a result of incomplete combustion, are fired again by the flame produced at the flame inlet ports 173 and 174, thereby reducing large particles to smaller particles and converting hazardous chemical compounds into non-hazardous micro-particles. Downstream from the flame inlet ports 173 and 174, the catalyst converters 18 remove additional amount of hazardous particles by filtration and chemical conversion. Since the size and the amount of the smoke particles are reduced upstream of the catalyst converters 18, the service life of the catalyst converters 18 can be prolonged, thereby minimizing the frequency of cleaning operation. With the provision of the catalyst converters 18, the load to be borne at the post-treatment stages can be minimized, and the efficiency of the post-treatment can be increased.

When the smoke is directed into the scrubbing chamber 161, the first spraying device 164 sprays sea-water, which contains basic substances, onto the smoke, thereby cooling the smoke and combining the smoke with the sea-water. The products of the scrubbing are led to the neutralization chamber 162 in which an alkaline solution is sprayed by the second spraying device 165 to remove additional hazardous substances. Finally, the products resulting from neutralization are discharged into the sea via the discharge port 168 and the discharge pipe 169.

Figure 3:
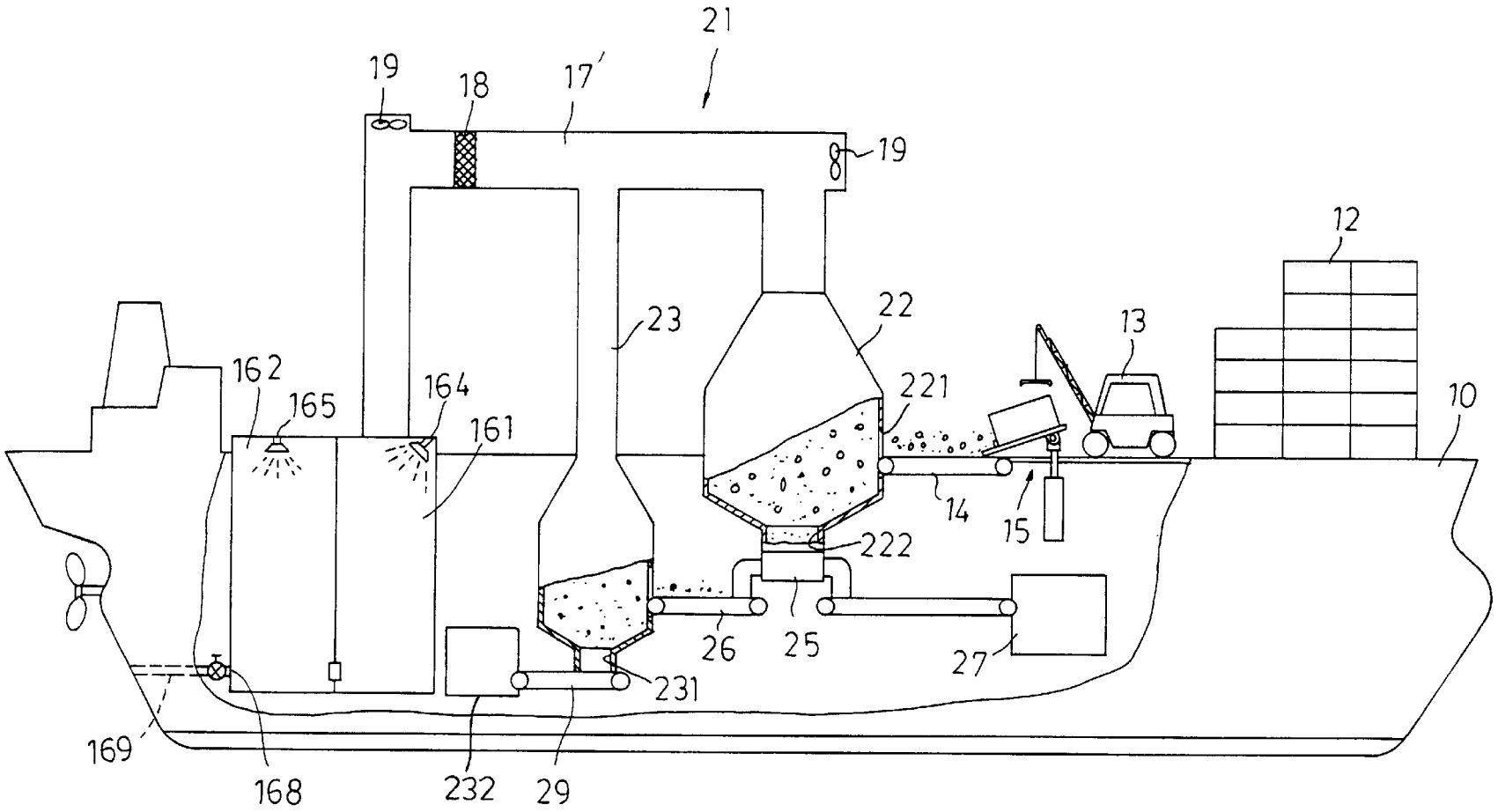
FIG. 3 is a schematic view of another embodiment of a waste-disposing sea-going vessel according to the present invention.

Of numerous kinds of incinerators, any suitable incinerator may be selected for use in the present invention. The incinerator may be a tunnel-type incinerator, a twin-incinerator, or a single incinerator. FIG. 3 shows another embodiment of the present invention, wherein elements similar to those employed in the previous embodiment are represented by like numerals. Except for the use of a twin-incinerator, this embodiment is substantially similar to the previous embodiment. In particular, this embodiment comprises a vessel body 10 and a twin-incinerator 21. The twin-incinerator 21 has a first incinerator 22, and a second incinerator 23. The first incinerator 22 has a waste inlet 221 adjacent to a conveyor belt 14. The bottom end of the first incinerator 22 is provided with a bottom outlet 222 and an ash-separating device 25. One side of the bottom outlet 222 is connected to the second incinerator 23 via a conveying belt 26. The other end of the bottom outlet 222 is connected to an ash collector 27. A bottom outlet portion 231 of the second incinerator 23 is connected to a waste residue collector 232 via a conveying belt 29. The top end of the second incinerator 23 is connected to a smoke-conveying pipe 17' upstream of a catalyst converter 18.

In operation, containers 12 are tilted by a tilting device 15 to deliver solid wastes onto the conveyor belt 14 which in turn feeds the solid wastes into the first incinerator 22. After a first incineration at a high temperature of about 500° C., the resulting ash and the products of incomplete combustion are separated by the ash-separating device 25. The ash is collected in the ash collector 27. The products of incomplete combustion are sent to the second incinerator 23 via the conveying belt 26 for a second incineration at a super-high temperature, preferably, about 1200° C. The resulting waste residue is discharged from the bottom outlet portion 231 and collected in the waste residue collector 232. Since the first incinerator 22 has burnt out the wastes, which are combustible at a temperature of lower than 500° C., a reduced amount of wastes are sent to the second incinerator 23 for incineration at a super-high temperature of about 1200° C., thereby saving energy as compared to the previous embodiment which employs a single incinerator that requires high energy to maintain a super-high temperature for all amounts of wastes.

Via the incinerator used in the present invention, the incompletely combusted hydrocarbon compounds can be converted into carbon dioxide. Carbon monoxide and sulfur monoxide can be converted into carbon dioxide and sulfur dioxide. The incompletely combusted oxygenated nitrogen compounds can be decomposed into nitrogen dioxide. Dioxime resulting from the combustion of polymeric compounds can be decomposed into carbon dioxide. In the scrubbing chamber, sulfur dioxide is formed into sulfate salts upon combination with sea-water. Nitrogen dioxide is converted into nitrate salts upon reaction with sea-water. The resulting salts can be further converted into chloride salts upon combination with sea-water. Carbon dioxide produces carbonate salts upon reaction with sea-water. Since the resulting sulfates, nitrates, chlorides and carbonates are stable and non-hazardous compounds in sea water, the wastes, which are finally discharged into the sea after the post-treatment of the smoke produced upon incineration in the present invention, are not harmful to living things and organisms in the sea.

By virtue of the present invention, solid wastes can be incinerated at sea, i.e. far from land, thereby eliminating the air pollution problems encountered with the incinerator installed on land.

With the invention thus explained, it is apparent that various modifications and variations can be made without departing from the spirit of the present invention. It is therefore intended that the invention be limited only as indicated in the pending claims.

What I claim is:

1. A waste-disposing sea-going vessel comprising:

a vessel body;

at least one incinerator mounted on the vessel body and having a waste inlet and a chimney for passage of the smoke produced by said incinerator;

a plurality of containers disposed on said vessel body for receiving solid wastes;

delivery means for delivering the solid wastes from said containers to said waste inlet;

a scrubbing chamber having a first spraying unit to spray sea-water onto the smoke directed to said scrubbing chamber from said chimney;

a smoke-conveying pipe connected to said chimney and said scrubbing chamber so as to direct the smoke from said chimney to said scrubbing chamber;

a neutralization chamber connected to said scrubbing chamber and having a second spraying unit for spraying an alkaline solution onto the substances entering said neutralization chamber from said scrubbing chamber; and discharge means for discharging the products formed in said neutralization chamber into the sea.

2. A waste-disposing sea-going vessel as claimed in claim 1, wherein said delivery means includes: a conveyor belt provided at said waste inlet and adapted to receive the solid wastes from said containers and to feed the solid wastes into said incinerator; a tilting device having a tilting platform to receive and tilt said containers so as to deliver the solid wastes from said containers to said conveyor belt, and a transporting cart to transport said containers to said tilting platform, said transporting cart having a crane to deliver said containers onto said tilting platform.

3. A waste-disposing sea-going vessel as claimed in claim 2, wherein said smoke-conveying pipe is provided with a catalyst converter therein.

4. A waste-disposing sea-going vessel as claimed in claim 3, wherein said smoke-conveying pipe is further provided with an exhaust fan.

5. A waste-disposing sea-going vessel as claimed in claim 4, wherein said smoke-conveying pipe further has a secondary burning unit provided upstream of said catalyst converter for burning large particles contained in the smoke directed from said chimney.

6. A waste-disposing sea-going vessel as claimed in claim 1, which comprises a plurality of said incinerators, said incinerators including a first incinerator and a second incinerator, said second incinerator operating at a temperature higher than that of said first incinerator.

7. A waste-disposing sea-going vessel as claimed in claim 6, wherein said first incinerator operates at a temperature of about 500° C., while said second incinerator operates at a temperature of about 1200° C., said first incinerator having a bottom outlet, said second incinerator being provided downstream of said first incinerator and having a waste inlet connected to said bottom outlet of said first incinerator for further combusting of the products of incineration of said first incinerator.

8. A waste-disposing sea-going vessel as claimed in claim 7, wherein said second incinerator has a top end connected to said smoke-conveying pipe, said smoke-conveying pipe containing a catalyst converter downstream of said second incinerator.

* * * * *